US007804246B2

(12) United States Patent
Amatsuchi et al.

(10) Patent No.: US 7,804,246 B2
(45) Date of Patent: Sep. 28, 2010

(54) PLASMA DISPLAY PANEL WITH ADDRESS ELECTRODE HAVING PROJECTIONS

(75) Inventors: Mario Amatsuchi, Tokyo (JP); Yasuhiro Torisaki, Tokyo (JP); Mitsuhiro Ohata, Tokyo (JP)

(73) Assignee: Panasonic Corporation, Kadoma (JP)

( * ) Notice: Subject to any disclaimer, the term of this patent is extended or adjusted under 35 U.S.C. 154(b) by 144 days.

(21) Appl. No.: 12/119,055

(22) Filed: May 12, 2008

(65) Prior Publication Data

US 2008/0309236 A1 Dec. 18, 2008

(30) Foreign Application Priority Data

Jun. 13, 2007 (JP) ..... 2007-156285

(51) Int. Cl.
*H01J 17/49* (2006.01)

(52) U.S. Cl. ..... 313/584; 313/582; 313/292

(58) Field of Classification Search ..... 313/498–512, 313/292

See application file for complete search history.

(56) References Cited

U.S. PATENT DOCUMENTS

2004/0130269 A1* 7/2004 Park ..... 313/586
2005/0062418 A1* 3/2005 Kang et al. ..... 313/582
2005/0225246 A1* 10/2005 Kim et al. ..... 313/587
2006/0091805 A1* 5/2006 Hur et al. ..... 313/584
2008/0084161 A1* 4/2008 Sano et al. ..... 313/582

FOREIGN PATENT DOCUMENTS

JP 11-065486 A 3/1999

* cited by examiner

*Primary Examiner*—Joseph L Williams
*Assistant Examiner*—Kevin Quarterman
(74) *Attorney, Agent, or Firm*—Arent Fox LLP

(57) ABSTRACT

Each of the column electrodes is divided into an upper electrode portion and a lower electrode portion. The panel surface is made up of an upper panel face facing the upper electrode portion and a lower panel face facing the lower electrode portion. A transverse wall of the partition wall unit is disposed facing the boundary area between the upper and lower panel faces. The upper and lower electrode portions of the column electrode have the opposing ends at which projections are respectively provided and extend out toward the respective other electrode portions.

8 Claims, 6 Drawing Sheets

FIRST EMBODIMENT

SECTION V-V

MODIFIED EXAMPLE

SECOND EMBODIMENT

MODIFIED EXAMPLE

THIRD EMBODIMENT

PLASMA DISPLAY PANEL WITH ADDRESS ELECTRODE HAVING PROJECTIONS

BACKGROUND OF THE INVENTION

1. Field of the Invention

This invention relates to a structure of plasma display panels.

The present application claims priority from Japanese Application No. 2007-156285, the disclosure of which is incorporated herein by reference.

2. Description of the Related Art

In the typical arrangement of plasma display panels (hereinafter referred to as "PDPs"), two opposing substrates are placed on either side of a discharge space, between which row electrode pairs and column electrodes are disposed and respectively extend in the row direction and the column direction at right angles to each other, so that discharge cells arranged in matrix form on the panel surface are formed in areas within the discharge space corresponding to the intersections of the row electrode pairs and the column electrodes. The PDP initiates discharges between one of each row electrode pair and the column electrode and between the row electrodes constituting each row electrode pair in the discharge cells. These discharges result in the emission of visible light from phosphor layers in the three primary colors, red, green, blue, provided in the respective discharge cells to generate a matrix-display image.

Some PDPs having such a structure conventionally comprise column electrodes extending in the column direction and each composed of a portion facing the upper portion of the panel surface and a portion facing the lower portion.

A conventional PDP having such a structure is disclosed in Japanese Patent Laid-Open No. H11-65486.

A PDP comprising such column electrodes each composed of upper and lower divisions produces the advantage of improvement in screen brightness. This is because, in the address discharge period (writing discharge period) when the PDP is driven, data pulses are applied individually to the upper division and the lower division of each column electrode to initiate the address discharge. This enables the shortening of the address discharge period to approximately half of that of earlier PDPs, which in turn enables the setting of an increased period of the sustaining discharge which is produced for the emission of visible light.

However, such PDPs comprising column electrodes each composed of upper and lower divisions have the following problem in the manufacturing process.

Specifically, in a typical PDP manufacturing process, a sandblasting technique is often used in the step of shaping partition walls on the substrate for partitioning the discharge space into discharge cells.

When the sandblasting technique is used for shaping partition walls of a PDP which comprises column electrodes each composed of an upper and a lower division as described above, in the step of using the sandblasting technique to shape the partition-wall layer, the amount of electrostatic charge varies between one portion of the partition wall layer corresponding to the boundary portion between the upper and lower divisions of each column electrode (the portion of the partition wall layer not facing the column electrode) and the remaining portions of the partition wall layer (the portions of the partition wall layer facing the column electrode). As a result, the sandblasting causes surface unevenness on the partition wall layer.

For this reason, in the subsequent calcination process, the surface unevenness caused by the sandblasting effects variations in the degree of shrinkage of the partition wall layer accompanying the calcinations between the portion of the partition wall layer facing the boundary portion of the column electrode and the remaining portions. As a result, the shape of the partition wall thus produced is out of the required shape, which then gives rise to the impossibility to form uniform discharge cells over the panel surface.

When the discharge cells cannot be uniformly formed over the panel surface as a consequence of this, the image displayed on the screen is uneven (hereinafter referred to as "uneven display").

Also, when such a sandblasting technique is used in the step of shaping the partition wall, for similar reasons, the partition wall has a greater height in the portion facing the boundary portion of the column electrode than in the remaining portions. As a result, the partition wall is in uneven contact with the structural components on the substrate facing the partition wall in this area, which may cause an audible noise.

On the other hand, when the sandblasting technique is not used for forming the partition wall, in the area corresponding to the boundary portion of each column electrode, a misalignment produced when the two substrates are placed on one another to face each other effects a change in the opposing area between the row electrode pair provided on one substrate and the column electrode provided on the other substrate. As a result, here again, an uneven display may occur on the screen.

This problem of an uneven display occurring on a PDP comprising column electrodes each composed of two divisions becomes much more notable in the development of a PDP capable of generating a high definition image such as the recently developed full HD display, because the shape of each discharge cell is smaller than that in a conventional PDP.

SUMMARY OF THE INVENTION

It is a technical object of the present invention to solve the problem associated with the conventional PDP as described above.

To attain this object, the present invention provides a PDP characterized by: a first substrate and a second substrate facing each other across a discharge space; row electrode pairs extending in a row direction and regularly arranged in a column direction on the inner face of the first substrate and each consisting of a first electrode and a second electrode; a plurality of column electrodes extending in the column direction and regularly arranged in the row direction on the inner face of the second substrate and forming unit light emission areas respectively corresponding to the intersections with the row electrode pairs in the discharge space; and a partition wall unit comprising at least a plurality of transverse walls extending in the row direction to partition the discharge space into the unit light emission areas, and characterized in that each of the column electrodes is divided into a first electrode portion and a second electrode portion, the panel surface of the PDP is made up of a first panel face facing the first electrode portion and a second panel face facing the second electrode portion, the transverse wall of the partition wall unit faces a boundary between the first panel face and the second panel face of the panel surface, and at least one of the first and second electrode portions of the column electrode has an end located close to the boundary between the first panel face and the second panel face of the panel surface and having a projection that extends out therefrom toward the other electrode portion and is opposite an end of the other electrode portion located close to the boundary between the first panel face and the second panel face.

In a best mode for carrying out the present invention, a PDP according to an aspect comprises: a first substrate and a second substrate facing each other across a discharge space; row electrode pairs extending in a row direction and regularly arranged in a column direction on the inner face of the first substrate and each consisting of a first electrode and a second electrode; a plurality of column electrodes extending in the column direction and regularly arranged in the row direction on the inner face of the second substrate and forming unit light emission areas respectively corresponding to the intersections with the row electrode pairs in the discharge space; and a partition wall unit comprising at least a plurality of transverse walls extending in the row direction to partition the discharge space into the unit light emission areas. Each of the column electrodes is divided into a first electrode portion and a second electrode portion. The panel surface of the PDP is made up of a first panel face facing the first electrode portion and a second panel face facing the second electrode portion. The transverse wall of the partition wall unit faces a boundary between the first panel face and the second panel face of the panel surface. At least one of the first and second electrode portions of the column electrode has an end located close to the boundary between the first panel face and the second panel face of the panel surface and having a projection that extends out therefrom toward the other electrode portion and faces an end of the other electrode portion located close to the boundary between the first panel face and the second panel face.

Because the above PDP comprises the column electrodes each divided into upper and lower portions, the PDP is designed to apply data pulses independently to the first electrode portion and the second electrode portion of the column electrode in the address discharge period when the PDP is driven, to perform an address scan simultaneously in the first panel face and the second panel face of the panel surface. As a result, the PDP is capable of shortening the address discharge period.

In the above PDP, a projection formed at, at least, one of the opposing ends of the respective first and second electrode portions of each column electrode is located on the boundary area between the first panel face and the second panel face of the panel surface. For this reason, even when sandblasting is performed in the step of shaping the partition wall unit in the manufacturing process of the PDP, in the sandblasting operation the amount of electrostatic charge generated on a portion of a partition wall layer located on the boundary area between the first panel face and the second panel face of the panel surface along which the column electrode is divided is approximately equal to that on the other portions of the partition wall layer (the remaining portions other than the portion located on the boundary area), thereby preventing the partition wall layer from suffering surface unevenness caused by the sandblasting.

Accordingly, the PDP designed as described above is prevented in the manufacturing process from suffering deformation coming from the surface unevenness on the partition wall layer, so that the partition wall unit can be formed in the predetermined shape. As a result, the unit light emission areas are formed in uniform shape over the full panel surface. This prevents the PDP, when being operated, from suffering an uneven display, making it possible to display a clear image with high definition.

In addition, because of the above design of the PDP, in the step of shaping the partition wall unit using the sandblasting, the height of a portion of the partition wall unit corresponding to the area in which each column electrode is divided is prevented from becoming greater than that of the other portions of the partition wall unit, which in turn prevents the contact between the partition wall unit and the structural components on the substrate facing the partition wall unit from being uneven in the above area, with the result that there is no chance of audible noise being caused.

In the PDP of the aspect, the projection preferably has a required area disposed in a position facing the transverse wall of the partition wall unit located in a boundary area between the first panel face and the second panel face of the panel surface, when viewed from the first substrate.

Because of this, when the sandblasting is performed in the step of shaping the partition wall unit in the PDP manufacturing process, the amount of electrostatic charge generated on the partition wall layer becomes more uniform over the full panel surface.

In a possible form of the projection employed in the PDP of the aspect, the projection is provided at each of the opposing ends of the respective first and second electrode portions of the column electrode, and has a width smaller than a row-direction width of each of the first and second electrode portions, and the projections formed at the respective ends extend out toward the respective other electrode portions and face each other across a required gap in the row direction.

The projections in this form are preferably disposed in positions extending outward in the opposite directions from each other beyond the row-direction width of the first electrode portion and the second electrode portion of the column electrode.

As a result, it is possible to ensure a process margin for the step for forming the column electrodes in the manufacturing process of the PDP.

In another possible form of the projection employed in the PDP of the foregoing aspect, the projection is provided at each of the opposing ends of the respective first and second electrode portions of the column electrode, and each of the projections is formed in an approximately triangular shape having a vertex-angled portion extending out toward the other electrode portion and has an oblique side of the triangular shape facing an oblique side of the other projection with a required space in between.

In this form, the vertex-angled portions of the projections are preferably disposed in a position extending outward in the opposite directions from each other beyond the row-direction width of the first electrode portion and the second electrode portion of the column electrode.

This makes it possible to ensure a process margin for the step for forming the column electrodes in the manufacturing process of the PDP.

In still another possible form of the projection employed in the PDP of the foregoing aspect, the first electrode portions of the respective column electrodes adjacent one another in the row direction have different lengths, and the first electrode portions which are longer and the first electrode portions which are shorter are alternated in position in the row direction. The second electrode portions of the respective column electrodes adjacent one another in the row direction have different lengths, and the second electrode portions which are longer and the second electrode portions which are shorter are alternated in position in the row direction. Then, each of the longer first electrode portions and each of the shorter second electrode portions are dispose end to end to form the column electrode, and each of the shorter first electrode portions and each of the longer second electrode portions are dispose end to end to form the column electrode. A portion of each of the longer first and second electrode portions corresponding to a difference in length in the column direction from each of the shorter first and second electrode portions adjacent to the longer first and second electrode portions form the projection.

In a possible form of the row electrode pair employed in the PDP according to the foregoing aspect, the first electrode and the second electrode constituting each of the row electrode pairs are arranged in reversed order in the column direction to those in the row electrode pairs adjacent thereto, and the first electrodes are respectively disposed on both sides of the boundary between the first panel face and the second panel face. Further, the second electrode is a scan electrode for initiating an address discharge between the scan electrode and the column electrode, and the first electrode is a sustaining electrode for initiating a sustaining discharge between the sustaining discharge and the second electrode.

In the PDP comprising the row electrode pairs of this form, when the first substrate and the second substrate are stacked on each other in the manufacturing process, even if the two substrates are misaligned, the opposing area between the column electrode and the row electrode serving as the scanning electrodes is not changed. As a result, there is no chance of an uneven display occurring.

These and other objects and features of the present invention will become more apparent from the following detailed description with reference to the accompanying drawings.

DETAILED DESCRIPTION OF THE PREFERRED EMBODIMENTS

Embodiment 1

Figure 1:
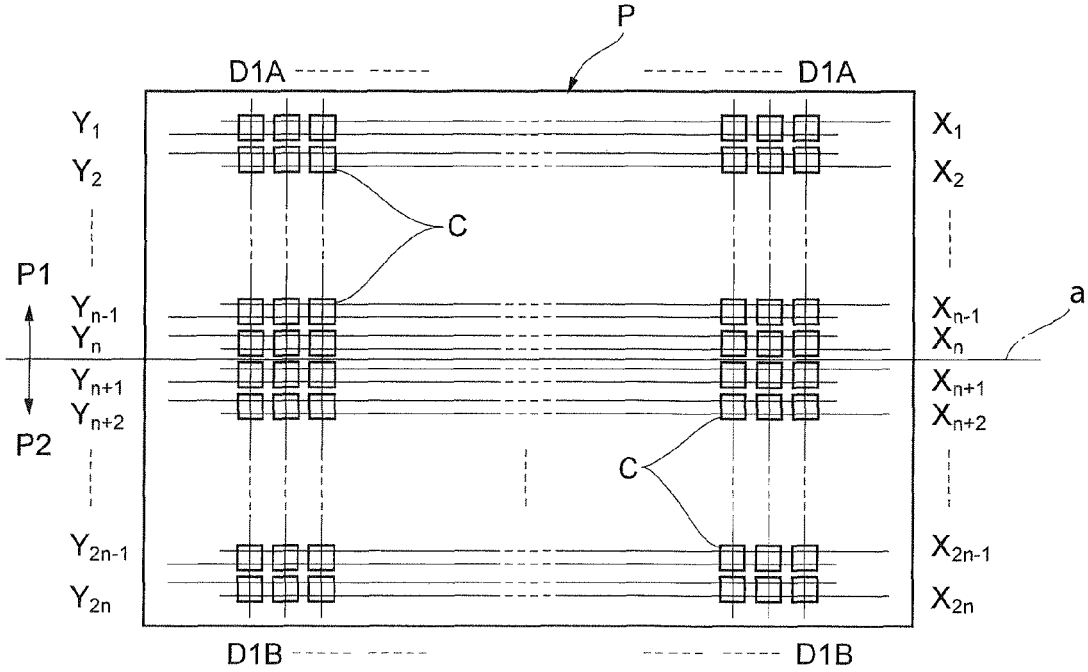
FIG. 1 is an illustration showing the layout of row electrode pairs of the PDP in a first embodiment according to the present invention.
Figure 2:
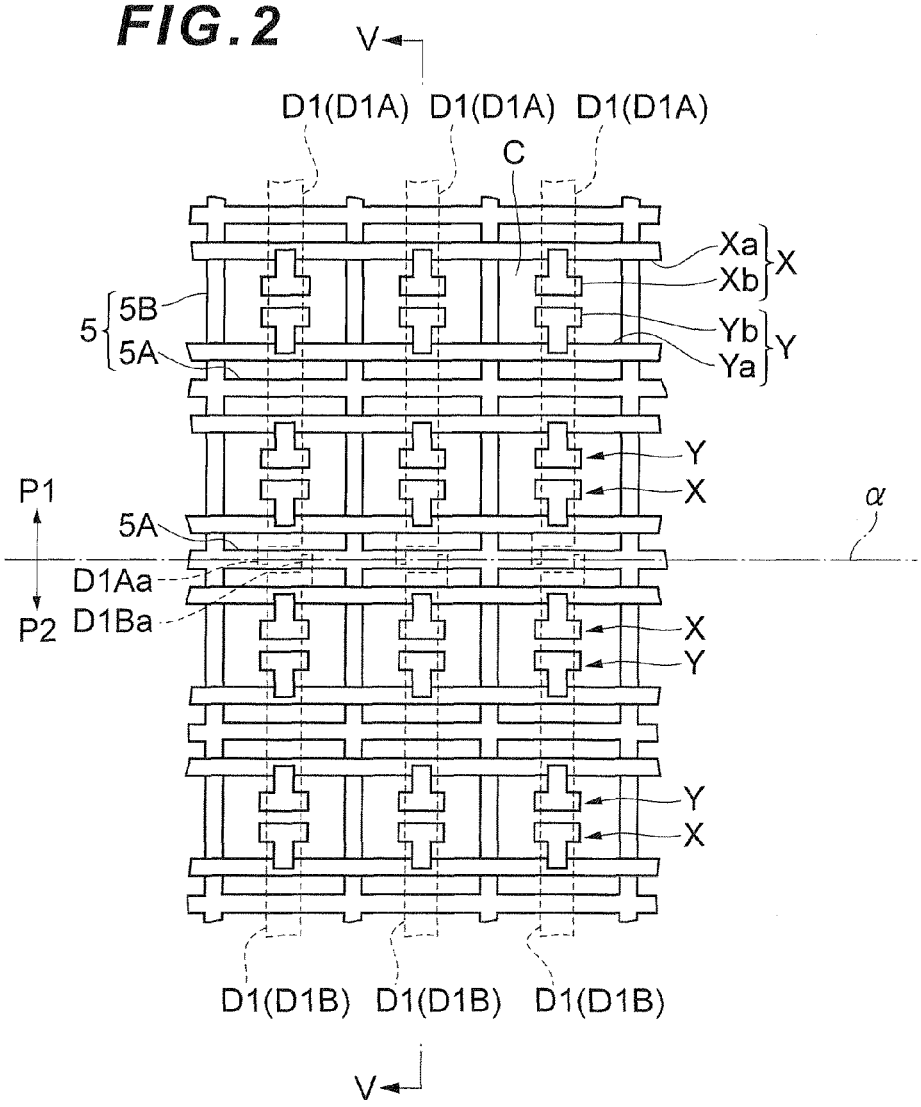
FIG. 2 is a front view illustrating the panel structure of the PDP of the first embodiment.
Figure 3:
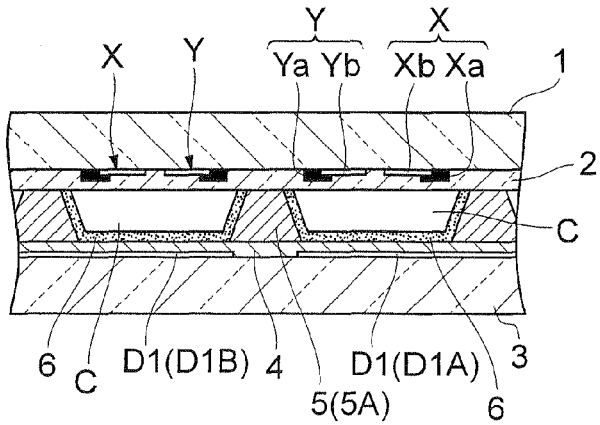
FIG. 3 is a sectional view taken along the V-V line in FIG. 2.

FIG. 1 to FIG. 3 illustrate a first embodiment of the PDP according to the present invention. FIG. 1 is a schematic configuration diagram showing the structure of the panel surface of the PDP in the first embodiment and the layout of the row electrodes. FIG. 2 is a schematic front view showing the structure of a central portion of the PDP in the first embodiment. FIG. 3 is a sectional view taken along the V-V line in FIG. 2.

In FIG. 1 to FIG. 3, the panel area of the panel surface P of the PDP in the first embodiment is divided equally into two upper and lower halves, an upper panel face P1 and a lower panel P2, across a boundary line α extending in the row direction (the right-left direction in FIG. 1) in the central portion of the panel surface P.

The PDP comprises a front glass substrate 1 serving as the display surface of the PDP, and a plurality of row electrode pairs (X, Y) provided on the rear face (facing the back of the PDP) of the front glass substrate 1. The row electrode pairs (X, Y) each extend in the row direction (the right-left direction in FIG. 2) of the front glass substrate 1 and are arranged at regular intervals in the column direction (the up-down direction in FIG. 2).

Each of the row electrodes X, Y constituting each of the row electrode pairs (X, Y) is composed of a metal-made bus electrode Xa (Ya), extending in bar shape in the row direction and a plurality of approximately T-shaped transparent electrodes Xb (Yb), equally spaced from each other and connected to the bus electrode Xa (Ya). The paired transparent electrodes Xb and Yb in each row electrode pair (X, Y) each extend out from the corresponding row electrode toward the other so that the wide tops of the transparent electrodes Xb and Yb face each other across a discharge gap g.

The row electrodes X and Y in a row electrode pair (X, Y) are positioned in reverse order in the column direction to those in each of the row electrode pairs (X, Y) adjacent thereto. As shown in FIG. 1, in the area corresponding to the upper panel face P1, the row electrodes X and Y are disposed in the form $X_1$-$Y_1$, $Y_2$-$X_2$, . . . , $X_{n-1}$-$Y_{n-1}$, $Y_n$-$X_n$. In the area corresponding to the lower panel face P2, the row electrodes X and Y are disposed in the form $X_{n+1}$-$Y_{n+1}$, $Y_{n+2}$-$X_{n+2}$, . . . , $X_{2n-1}$-$Y_{2n-1}$, $Y_{2n}$-$X_{2n}$. The row electrodes X ($X_1$ and $X_n$) are assigned to both the top line and the bottom line of the upper panel face P1. Likewise, The row electrodes X ($X_{n+1}$ and $X_{2n}$) are assigned to both the top line and the bottom line of the lower panel face P2.

A dielectric layer 2 is further deposited on the rear face of the front glass substrate 1 so as to overlie the row electrode pairs (X, Y).

In turn, a protective layer (not shown) formed of a high-γ material such as MgO covers the rear face of the dielectric layer 2.

The front glass substrate 1 is placed parallel to a back glass substrate 3 across the discharge space. A plurality of column electrodes D1 extend on the inner face (facing the front glass substrate 1) of the back glass substrate 3. Each of the column electrodes D1 is disposed in a position corresponding to the paired transparent electrodes Xb, Yb of the row electrode pairs (X, Y) which face each other across the discharge gap g.

Each of the column electrodes D1 is divided into two, an upper electrode portion D1A corresponding to the upper panel face P1 and a lower electrode portion D1B corresponding to the lower panel face P2.

The arrangement and the shape of the upper electrode portion D1A and the lower electrode portion D1B of the column electrode D1 will be described in detail later.

A column-electrode protective layer 4 is further deposited on the inner face of the back glass substrate 3 so as to overlie the column electrodes D1.

A partition wall unit 5 is deposited on the column-electrode protective layer 4. The partition wall unit 5 is formed approximately in a grid shape made up of a plurality of transverse walls 5A and a plurality of vertical walls 5B. Each of the transverse walls 5A extends in the row direction in a position corresponding to the area between the row electrode X and the row electrode Y of the respective row electrode pairs (X, Y) which are adjacent to each other. Each of the vertical walls 5B extends in the column direction in a position corresponding to the area extending through points between the adjacent transparent electrodes Xb and points between the adjacent transparent electrodes Yb arranged in the row direction.

The partition wall unit 5 partitions the discharge space defined between the front glass substrate 1 and the back glass substrate 3 into areas each of which faces the paired transparent electrodes Xb and Yb facing each other across the discharge gap gin the row electrode pair (X, Y) to form discharge cells C arranged in matrix form over the panel surface.

In the discharge cells C, red, green and blue phosphor layers 6 are respectively deposited in the discharge cells C such that the red, green and blue colors are arranged in order in the row direction.

The discharge space hermetically sealed between front glass substrate 1 and the back glass substrate 3 is filled with a discharge gas including xenon.

As for the column electrode D1, in FIG. 2 when viewed from the panel front, the bottom leading end of the upper electrode portion D1A and the top leading end of the lower electrode portion D1B face each other across the transverse wall 5A of the partition wall unit 5 which is positioned on the boundary line α between the upper panel face P1 and the lower panel face P2 of the panel surface P.

The bottom leading end of the upper electrode portion D1A of the column electrode D1 has a bar-shaped projection D1Aa formed integrally therewith and extending out linearly in the column direction from one side (the left side in the example shown in FIG. 2) toward the lower panel face P2. The top leading end of the lower electrode portion D1B of the column electrode D1 has a bar-shaped projection D1Ba formed integrally therewith and extending out linearly in the column direction from the other side (the right side in the example shown in FIG. 2) toward the upper panel face P1.

The projection D1Aa of the upper electrode portion D1A of the column electrode D1 and the projection D1Ba of the lower electrode portion D1B both face the transverse wall 5A of the partition wall unit 5 which is located on the boundary line α between the upper panel face P1 and the lower panel face P2 of the panel surface P.

The projection D1Aa of the upper electrode portion D1A of the column electrode D1 and the projection D1Ba of the lower electrode portion D1B face each other in the row direction across a required interval (which is approximately equal to the row-direction width of the column electrode in the example in FIG. 2), and are out of contact with other, in the area facing the transverse wall 5A located on the boundary line α.

The foregoing PDP initiates a reset discharge between the row electrodes X and Y in each row electrode pair (X, Y) to initialize all the discharge cells C, then initiates an address discharge selectively between the row electrode Y and the column electrode D1 to select the discharge cells (light-emission cells) C from which visible light is to be emitted and the discharge cells (non-light-emission cells) C from which visible light is not to be emitted. Then, a sustaining discharge is produced between the row electrodes X and Y of the row electrode pair (X, Y) in each of the light-emission cells C in order for the red, green and blue phosphor layers 6 to emit visible light, resulting in an image formed by the matrix display.

Because each column electrode D1 is equally divided into the upper and lower divisions, the PDP is designed to apply data pulses independently to the upper electrode portion D1A and the lower electrode portion D1B of the column electrode D1 in the address discharge period when the PDP is driven, to perform an address scan simultaneously in the upper panel face P1 and the lower panel face P2 of the panel surface P. As a result, the PDP is capable of shortening the address discharge period.

Each of the column electrodes D1 of the PDP is divided into an upper electrode portion D1A and a lower electrode portion D1B, while the projection D1Aa provided at the bottom leading end of the upper electrode portion D1A and the projection D1Ba provided at the top leading end of the lower electrode portion D1B both face the transverse wall 5A of the partition wall unit 5 located on the boundary line α between the upper panel face P1 and the lower panel face P2 of the panel surface P.

As a result, even when the sandblasting is performed in the step of shaping the partition wall unit in the PDP manufacturing process, the amount of electrostatic charge generated on the portion (transverse wall) of the partition wall layer located on the boundary line cc between the upper panel face P1 and the lower panel face P2 of the panel surface P along which the column electrode D1 is divided is approximately equal to that on the other portions of the partition wall layer (the remaining portions other than the portion located on the boundary line α), thereby preventing the partition wall layer from suffering surface unevenness caused by the sandblasting.

Accordingly, the PDP designed as described above is prevented in the manufacturing process from suffering deformation coming from the surface unevenness on the partition wall layer, so that the partition wall unit 5 can be formed in the predetermined shape. As a result, the discharge cells are formed in uniform shape over the full panel surface P. This prevents the PDP, when being operated, from suffering an uneven display, making it possible to display a clear image with high definition.

In addition, with this PDP, the partition wall layer is electrostatically charged uniformly in the step of shaping the partition wall unit by the sandblasting. This prevents the height of the transverse wall 5A corresponding to the area between the divisions of each column electrode D1 from becoming greater than that of the other portions of the partition wall unit 5, which in turn prevents the contact between the partition wall unit 5 and the structural components on the front glass substrate 1 from being uneven in the above area, with the result that there is no chance of audible noise being caused.

In addition, the row electrode X, serving as the sustaining electrode, of the row electrodes X and Y constituting each row electrode pair (X, Y) is located close to and facing the boundary line α where the column electrode D1 is divided. Because of this, when the front glass substrate 1 and the back glass substrate 3 are stacked on each other in the manufacturing process, even if the two substrates are misaligned, the opposing area between the column electrode D1 and the row electrode Y serving as the scanning electrodes is not changed. As a result, there is no chance of an uneven display occurring.

In the foregoing, the projections D1Aa and D1Ba of the column electrode D1 are respectively formed at the ends of the upper electrode portion D1A and the lower electrode portion D1B in such a manner as to extend out laterally beyond the width of the main bodies of the upper and lower electrode portions D1A and D1B. This is for the purpose of ensuring a process margin for the step for forming the column electrodes in the manufacturing process.

Figure 4:
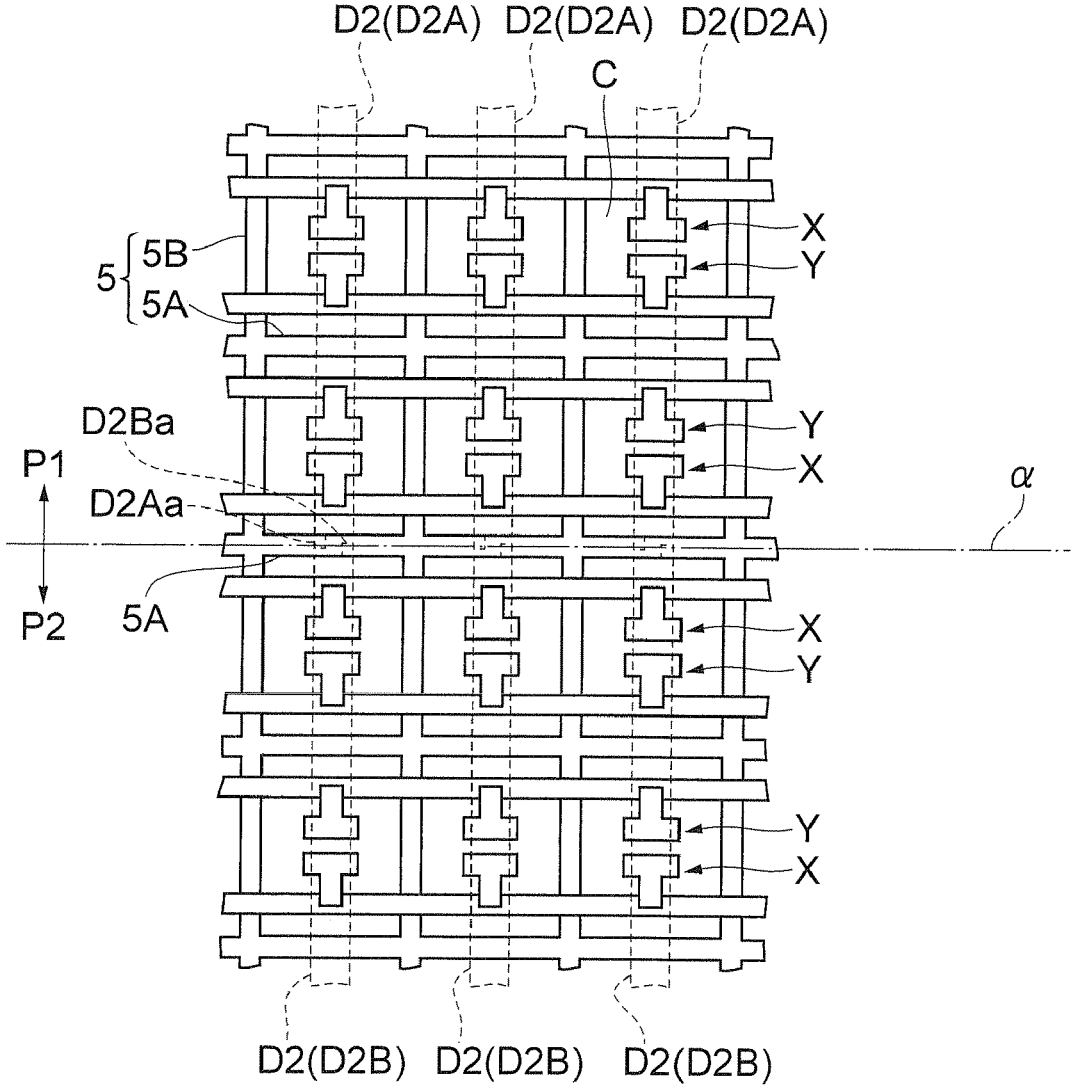
FIG. 4 is a front view illustrating a modified example of the first embodiment.

However, when provision of such a process margin for the step of forming the column electrodes is not required, as in the case of a column electrode D2 as shown in FIG. 4, a projection D2Aa may be shaped so as to extend out toward the lower panel face P2 without extending out laterally from one side of the leading end of the upper electrode portion D2A (the left side in the example in FIG. 4) beyond the width of the main body of the upper electrode portion D2A. A projection D2Ba may be shaped so as to extend out toward the upper panel face P1 without extending out laterally from the other side of the leading end of the lower electrode portion D2B (the right side in the example in FIG. 4) beyond the width of the main body of the lower electrode portion D2B.

Embodiment 2

Figure 5:
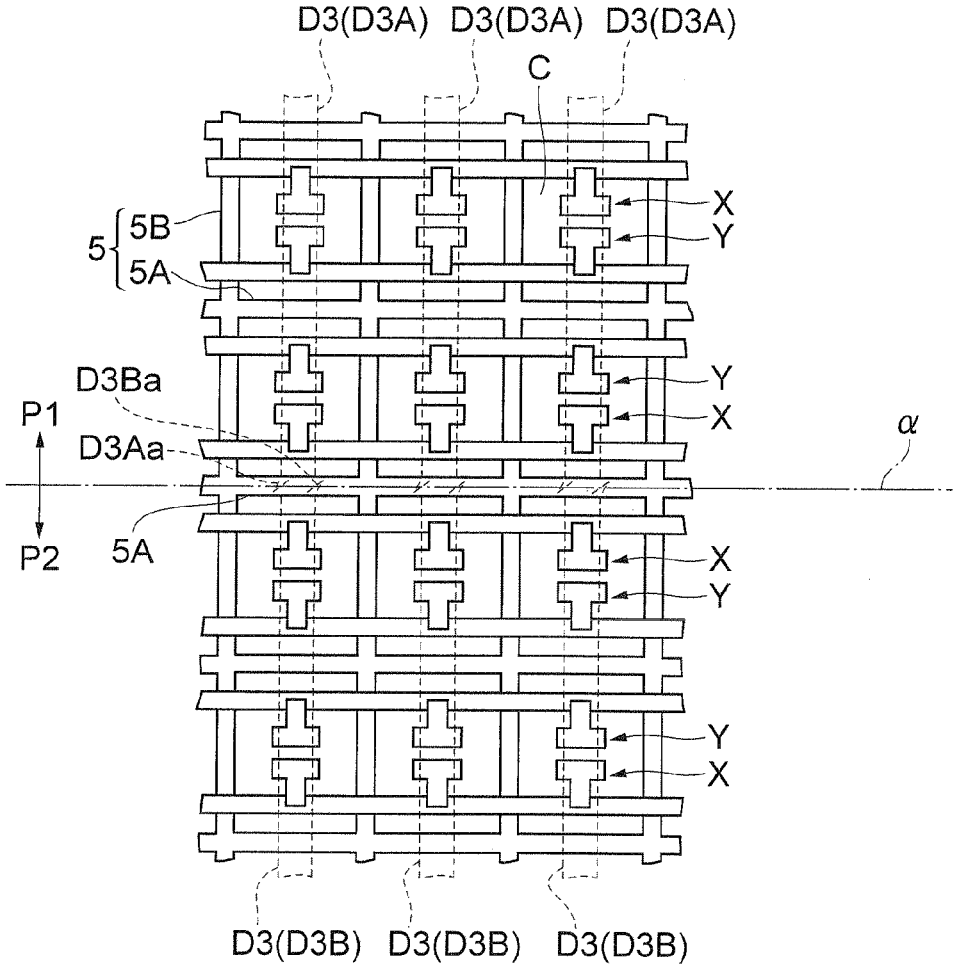
FIG. 5 is a front view illustrating the panel structure of the PDP of a second embodiment of the present invention.

FIG. 5 is a schematic front view illustrating a second embodiment of the PDP according to the present invention.

As in the case of the first embodiment, in FIG. 5, the PDP of the second embodiment comprises column electrodes D3 each divided into an upper electrode portion D3A and a lower electrode portion D3B. The bottom leading end of the upper electrode portion D3A and the top leading end of the lower electrode portion D3B face each other across the boundary line a between the upper panel face P1 and the lower panel face P2 of the panel surface.

A projection D3Aa of an approximately triangular shape when viewed from the panel surface is formed integrally with one side (the left side in the example in FIG. 5) of the bottom leading end of the upper electrode portion D3A of the column electrode D3 so as to extend in the direction of the lower panel face P2.

Likewise, a projection D3Ba of an approximately triangular shape is formed integrally with the other side (the right side in the example in FIG. 5) of the top leading end of the lower electrode portion D3B so as to extend in the direction of the upper panel face P1.

In the area corresponding to the transverse wall 5A on the boundary line α, the projection D3Aa of the upper electrode portion D3A of the column electrode D3 and the projection D3Ba of the lower electrode portion D3B have oblique sides at the leading ends facing parallel to each other across a required space, and out of contact with each other.

The structure of the other components of the PDP in the second embodiment is roughly similar to that of the PDP in the first embodiment. The similar components are indicated with the same reference numerals in FIG. 5 as those in FIG. 2.

As in the case of the PDP of the first embodiment, the PDP is capable of achieving a reduction of the address discharge period when the PDP is operated because each of the column electrodes D3 is divided into the upper and lower portions.

In the PDP, the projection D3Aa provided at the bottom leading end of the upper electrode portion D3A of each column electrode D3 and the projection D3Ba provided at the top leading end of the lower electrode portion D3B both face the transverse wall 5A of the partition wall unit 5 located on the boundary line a between the upper panel face P1 and the lower panel face P2 of the panel surface P. For this reason, even when the sandblasting is performed in the step of shaping the partition wall unit in the PDP manufacturing process, the amount of electrostatic charge generated on the portion of the partition wall layer located on the boundary line α between the upper panel face P1 and the lower panel face P2 of the panel surface P along which the column electrode D3 is divided is approximately equal to the amount of electrostatic charge generated on the other portions of the partition wall layer, thereby preventing the partition wall layer from suffering surface unevenness caused by the sandblasting.

Accordingly, the PDP designed as described above is prevented in the manufacturing process from suffering deformation coming from the surface unevenness on the partition wall layer, so that the partition wall unit 5 can be formed in the predetermined shape. As a result, the discharge cells are formed in a uniform shape over the full panel surface P. This prevents the PDP, when being operated, from suffering an uneven display, so as to display a clear image with high definition.

In addition, in this PDP, because the projection D3Aa of the upper electrode portion D3A and the projection D3ba of the lower electrode portion D3B are each formed in a triangular shape, in the partition-wall shaping step in the manufacturing process of the PDP, the opposing area between the projections D3Aa and D3Ba and the portion of the partition-wall layer located on the boundary line α between the upper panel face P1 and the lower panel P2 of the panel surface P is increased as compared with that in the case of the first embodiment. Because of this, in the sandblasting operation, the amount of electrostatic charge on the portion of the partition-wall layer located on the boundary line a and on the other portions thereof is more uniform than in the case of the first embodiment, thus making it possible to prevent the partition wall layer from suffering surface unevenness caused by the sandblasting.

The other beneficial advantages in the second embodiment are quite similar to those in the first embodiment.

In the foregoing, the projections D3Aa and D3Ba of the column electrode D3 are provided in the form that the respective vertex-angled portions at the leading ends respectively extend laterally beyond the width of the main bodies of the upper electrode portion D3A and the lower electrode portion D3B. This is for the purpose of ensuring a process margin used in the step for forming the column electrodes in the manufacturing process.

Figure 6:
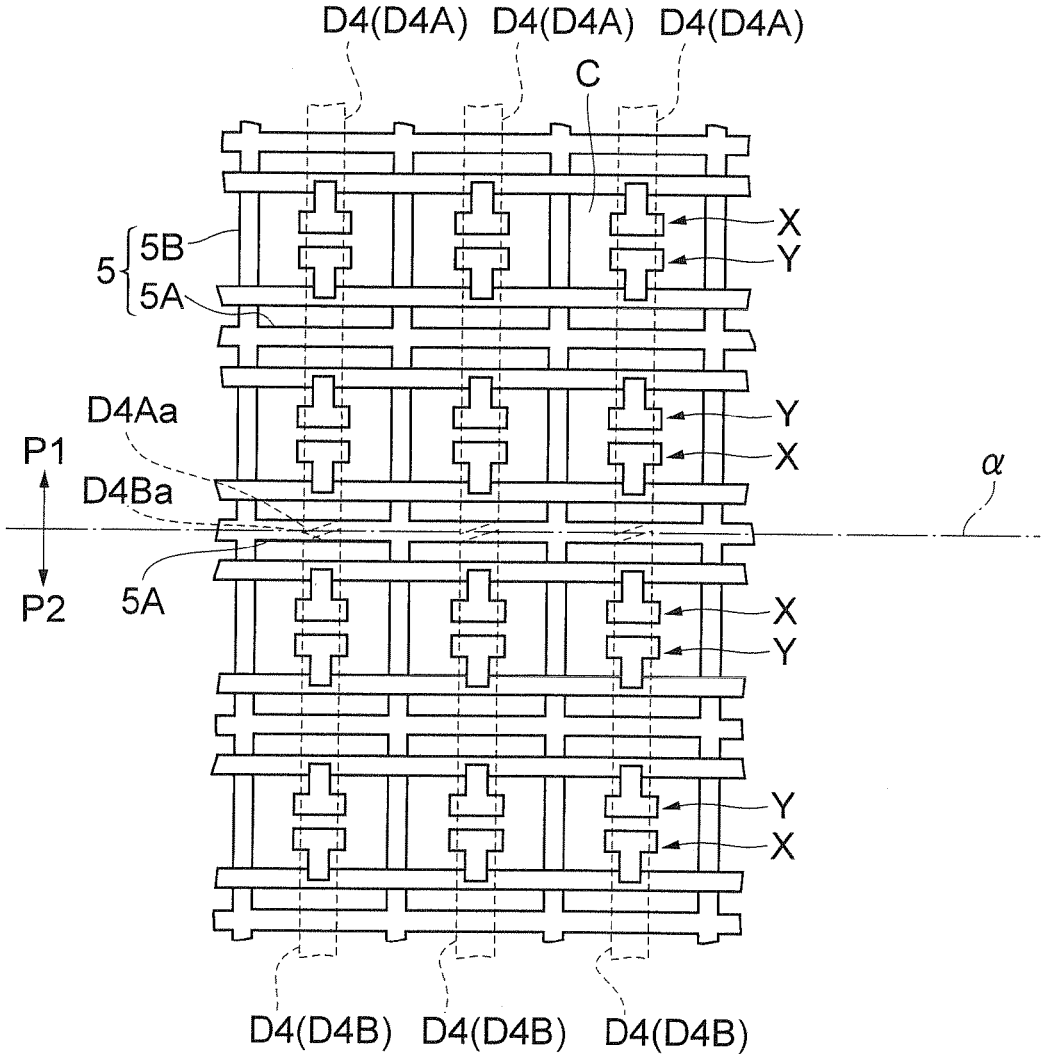
FIG. 6 is a front view illustrating a modified example of the second embodiment.

However, when provision of such a process margin for the step of forming the column electrodes is not required, as in the case of a column electrode D4 as shown in FIG. 6, the bottom end of an upper electrode portion D4A and the top end of a lower electrode portion D4B may be shaped so as to extend obliquely with respect to the axis of the column electrode D4 extending in the column direction. In this manner, triangularly shaped projections D4Aa and D4Ba may be shaped so as to respectively extend out toward the lower panel face P2 and toward the upper panel face P1 such that the vertex-angled portions of the triangular projections D4Aa and D4Ba do not extend out laterally beyond the width of the main bodies of the respective upper and lower electrode portions D4A and D4B.

Embodiment 3

Figure 7:
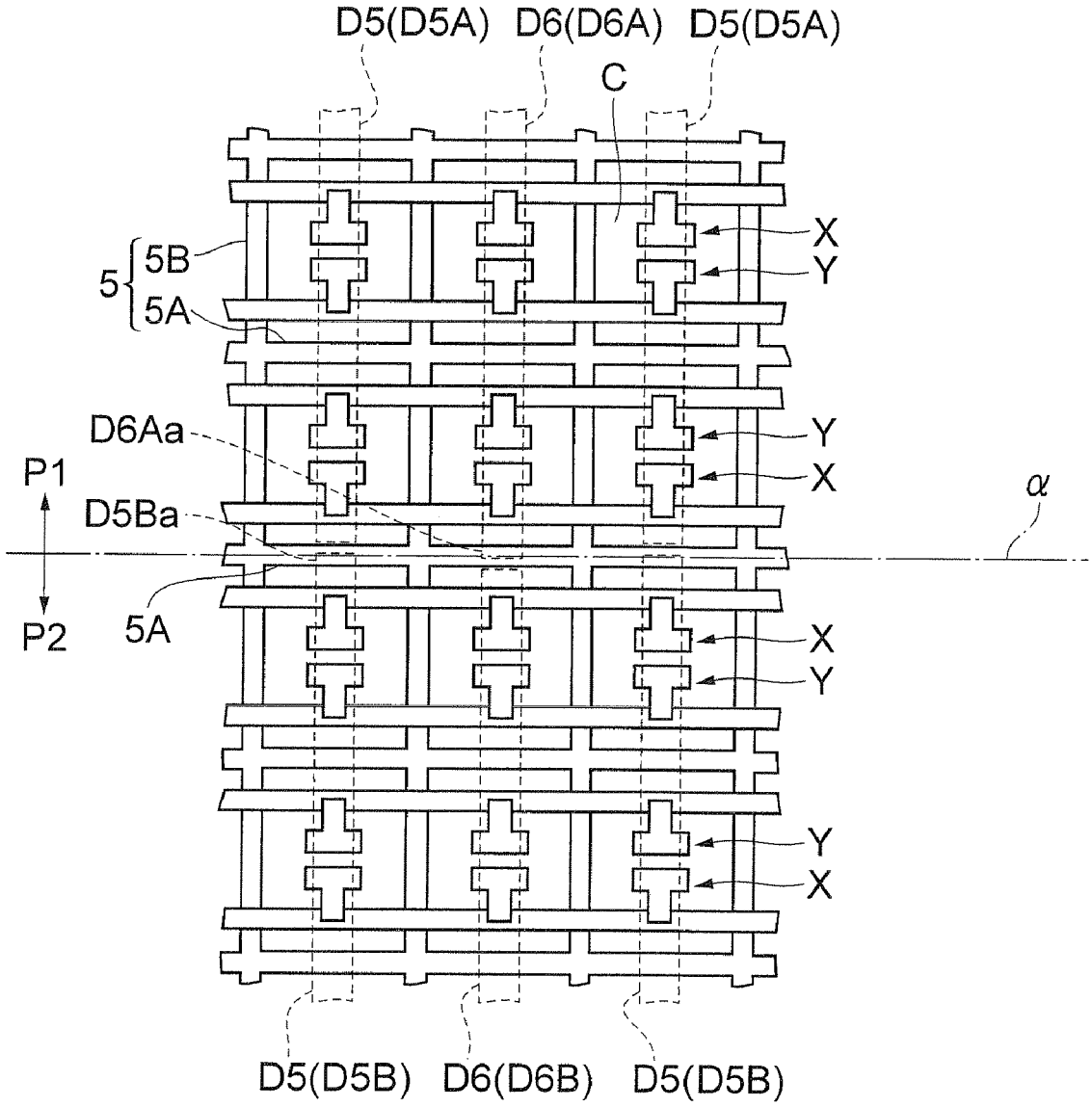
FIG. 7 is a front view illustrating the panel structure of the PDP of a third embodiment of the present invention.

FIG. 7 is a schematic front view illustrating a third embodiment of the PDP according to the present invention.

In FIG. 7, the PDP of the third embodiment comprises column electrodes D5 and D6 alternated in position in the row direction.

As in the case of the first embodiment, each of the electrodes D5 and D6 is divided into an upper electrode portion D5A (D6A) and a lower electrode portion D5B (D6B). The upper electrode portions D5A and D6A differ in length from each other. Likewise, the lower electrode portions D5B and D6B differ in length from each other.

Specifically, the upper electrode portion D6A of the column electrode D6 has a greater length in the column direction than that of the upper electrode portion D5A of the column electrode D5. The bottom leading end D6Aa of the upper electrode portion D6A extends cross the boundary line α into the lower panel face P2 so as to face the transverse wall 5A located on the boundary line a, whereas the bottom leading end of the upper electrode portion D5A do not face the transverse wall 5A located on the boundary line α between the upper panel face P1 and lower panel face P2 of the panel surface P.

On the other hand, the lower electrode portion D5B of the column electrode D5 has a greater length in the column direction than that of the lower electrode portion D6B of the column electrode D6. The top leading end D5Ba of the lower electrode portion D5B extends cross the boundary line α into the upper panel face P1 so as to face the transverse wall 5A located on the boundary line α, whereas the top leading end of the lower electrode portion D6B do not face the transverse wall 5A located on the boundary line α.

The bottom leading end of the upper electrode portion D5A of the column electrode D5 and the top leading end of the lower electrode portion D5B are out of contact with each other and face each other across a required gap in a position close the boundary line α in the upper panel face P1.

Likewise, the bottom leading end of the upper electrode portion D6A of the column electrode D6 and the top leading end of the lower electrode portion D6B are out of contact with each other and face each other across a required gap in a position close the boundary line α in the lower panel face P2.

As in the case of the PDP of the first embodiment, the PDP is capable of achieving a reduction of the address discharge period when the PDP is operated because each of the column electrodes D5, D6 is equally divided into two.

In the PDP, the top leading end D5Ba of the lower electrode portion D5B of each column electrode D5 and the bottom leading end D6Aa of the upper electrode portion D6A of each column electrode D6 both face the transverse wall 5A of the partition wall unit 5 located on the boundary line α between the upper panel face Pl and the lower panel face P2 of the panel surface P. Accordingly, the top leading end D5Ba and the bottom leading end D6Aa have a function quite similar to the projections provided in the upper electrode portion and the lower electrode portion of the column electrode in the first and second embodiments.

As a result, even when the sandblasting is performed in the step of shaping the partition wall unit in the PDP manufacturing process, the amount of electrostatic charge generated on the portion of the partition wall layer located on the boundary line a between the upper panel face P1 and the lower panel face P2 of the panel surface P along which the column electrodes D5, D6 are divided is approximately equal to the amount of electrostatic charge generated on the other portions of the partition wall layer, thereby preventing the partition wall layer from suffering surface unevenness caused by the sandblasting.

Accordingly, the PDP is prevented in the manufacturing process from suffering deformation coming from the surface unevenness on the partition wall layer, so that the partition wall unit 5 can be formed in the predetermined shape. As a result, the discharge cells are formed in a uniform shape over the full panel surface P. This prevents the PDP, when being operated, from suffering an uneven display, so as to display a clear image with high definition.

In addition, in this PDP, the column electrode D5 differs in the divided position from the column electrode D6. The top leading end of the lower electrode portion D5B of the column electrode D5 and the bottom leading end of the upper electrode portion D6A of the column electrode D6 alternately face the transverse wall SA of the partition wall unit 5 located on the boundary line α between the upper panel face P1 and the lower panel P2 of the panel surface P. In this case, there is no necessity to provide the projections shaped as described in the first and the second embodiment, which makes it possible to facilitate the formation of the column electrodes D5, D6.

The PDP described in each of the aforementioned embodiments is based on a basic idea that a plasma display panel comprises: a first substrate and a second substrate facing each other across a discharge space; row electrode pairs extending in a row direction and regularly arranged in a column direction on the inner face of the first substrate and each consisting of a first electrode and a second electrode; a plurality of column electrodes extending in the column direction and regularly arranged in the row direction on the inner face of the second substrate and forming unit light emission areas respectively corresponding to the intersections with the row electrode pairs in the discharge space; and a partition wall unit comprising at least a plurality of transverse walls extending in the row direction to partition the discharge space into the unit light emission areas, in which each of the column electrodes is divided into a first electrode portion and a second electrode portion, the panel surface of the PDP is made up of a first panel face facing the first electrode portion and a second panel face facing the second electrode portion, and the transverse wall of the partition wall unit faces a boundary between the first panel face and the second panel face of the panel surface. Then, in the plasma display panel, at least one of the first and second electrode portions of the column electrode has an end located close to the boundary between the first panel face and the second panel face of the panel surface and having a projection that extends out therefrom toward the other electrode portion and faces an end of the other electrode portion located close to the boundary between the first panel face and the second panel face.

Because the PDP based on this basic idea comprises the column electrodes each divided into first and second portions, the PDP is designed to apply data pulses independently to the first electrode portion and the second electrode portion of the column electrode in the address discharge period when the PDP is driven, to perform an address scan simultaneously in the first panel face and the second panel face of the panel surface. As a result, the PDP is capable of shortening the address discharge period.

In addition, a projection formed at, at least, one of the opposing ends of the respective first and second electrode portions of each column electrode is located on the boundary area between the first panel face and the second panel face of the panel surface. For this reason, even when sandblasting is performed in the step of shaping the partition wall unit in the manufacturing process of the PDP, in the sandblasting operation the amount of electrostatic charge generated on a portion of a partition wall layer located on the boundary area between the first panel face and the second panel face of the panel surface along which the column electrode is divided is approximately equal to that on the other portions of the partition wall layer (the remaining portions other than the portion located on the boundary area), thereby preventing the partition wall layer from suffering surface unevenness caused by the sandblasting.

Accordingly, the PDP designed as described above is prevented in the manufacturing process from suffering deformation coming from the surface unevenness on the partition wall layer, so that the partition wall unit can be formed in the predetermined shape. As a result, the unit light emission areas are formed in uniform shape over the full panel surface. This prevents the PDP, when being operated, from suffering an uneven display, making it possible to display a clear image with high definition.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, comprising:

a first substrate and a second substrate facing each other across a discharge space;

row electrode pairs extending in a row direction and regularly arranged in a column direction on the inner face of the first substrate and each consisting of a first electrode and a second electrode;

a plurality of column electrodes extending in the column direction and regularly arranged in the row direction on the inner face of the second substrate and forming unit light emission areas respectively corresponding to the intersections with the row electrode pairs in the discharge space; and a partition wall unit comprising at least a plurality of transverse walls extending in the row direction to partition the discharge space into the unit light emission areas, wherein each of the column electrodes is divided into a first electrode portion and a second electrode portion, the panel surface of the PDP is made up of a first panel face facing the first electrode portion and a second panel face facing the second electrode portion, the transverse wall of the partition wall unit faces a boundary between the first panel face and the second panel face of the panel surface, and at least one of the first and second electrode portions of each of the column electrodes has an end located in proximity to the boundary between the first panel face and the second panel face of the panel surface and having a projection that extends out therefrom toward the other electrode portion and is opposite an end of the other electrode portion located in proximity to the boundary between the first panel face and the second panel face;

wherein the projection is provided at each of the opposing ends of the respective first and second electrode portions of the column electrode, and has a width smaller than a row-direction width of each of the first and second electrode portions, and the projections formed at the respective ends extend out toward the respective other electrode portions and face each other across a required gap in the row direction.

2. A plasma display panel according to claim 1, wherein the projection has a required area disposed in a position facing the transverse wall of the partition wall unit located in a boundary area between the first panel face and the second panel face of the panel surface, when viewed from the first substrate.

3. A plasma display panel according to claim 1, wherein the projections are disposed in positions extending outward in the opposite directions from each other beyond the row-direction width of the first electrode portion and the second electrode portion of the column electrode.

4. A plasma display panel according to claim 1, wherein the projection is provided at each of the opposing ends of the respective first and second electrode portions of the column electrode, and each of the projections is formed in an approximately triangular shape having a vertex-angled portion extending out toward the other electrode portion and has an oblique side of the triangular shape facing an oblique side of the other projection with a required space in between.

5. A plasma display panel according to claim 4, wherein the vertex-angled portions of the projections are disposed in a position extending outward in the opposite directions from each other beyond the row-direction width of the first electrode portion and the second electrode portion of the column electrode.

6. A plasma display panel according to claim 1, wherein the first electrode portions of the respective column electrodes adjacent one another in the row direction have different lengths, and the first electrode portions which are longer and the first electrode portions which are shorter are alternated in position in the row direction the second electrode portions of the respective column electrodes adjacent one another in the row direction have different lengths, and the second electrode portions which are longer and the second electrode portions which are shorter are alternated in position in the row direction, each of the longer first electrode portions and each of the shorter second electrode portions are dispose end to end to form the column electrode, and each of the shorter first electrode portions and each of the longer second electrode portions are dispose end to end to form the column electrode, a portion of each of the longer first and second electrode portions corresponding to a difference in length in the column direction from each of the shorter first and second electrode portions adjacent to the longer first and second electrode portions form the projection.

7. A plasma display panel according to claim 1, wherein the first electrode and the second electrode constituting each of the row electrode pairs are arranged in reversed order in the column direction to those in the row electrode pairs adjacent thereto, and the first electrodes are respectively disposed on both sides of the boundary between the first panel face and the second panel face.

8. A plasma display panel according to claim 7, wherein the second electrode is a scan electrode for initiating an address discharge between the scan electrode and the column electrode, and the first electrode is a sustaining electrode for initiating a sustaining discharge between the sustaining discharge and the second electrode.

* * * * *